US007887041B2

(12) United States Patent
Takiguchi

(10) Patent No.: US 7,887,041 B2
(45) Date of Patent: Feb. 15, 2011

(54) FEED ROLLER ASSEMBLY AND IMAGE FORMING APPARATUS

(75) Inventor: Toshiki Takiguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 15 days.

(21) Appl. No.: 11/882,432

(22) Filed: Aug. 1, 2007

(65) Prior Publication Data

US 2008/0029954 A1 Feb. 7, 2008

(30) Foreign Application Priority Data

Aug. 3, 2006 (JP) ..... 2006-212552

(51) Int. Cl.
*B65H 3/06* (2006.01)
*F16C 13/00* (2006.01)

(52) U.S. Cl. ..... 271/109; 271/314; 492/39; 492/40

(58) Field of Classification Search ..... 271/109, 271/275, 314, 264; 492/39, 40
See application file for complete search history.

(56) References Cited

U.S. PATENT DOCUMENTS 2,718,670 A * 9/1955 Harley, Sr. ..... 19/265
2,730,770 A * 1/1956 Higginbotham et al. .. 15/256.52
3,330,460 A * 7/1967 Wick ..... 226/175
4,717,938 A * 1/1988 Tanjo ..... 399/388
4,729,557 A * 3/1988 Kiyohara ..... 271/272
5,472,182 A * 12/1995 Han ..... 271/3.13
6,050,395 A * 4/2000 Shannon et al. ..... 198/831
6,581,930 B2 * 6/2003 Kim ..... 271/272
6,705,609 B2 * 3/2004 Kim ..... 271/262
7,427,065 B2 * 9/2008 Maruyama ..... 271/273
2006/0255527 A1 * 11/2006 Sheng ..... 271/121

FOREIGN PATENT DOCUMENTS

JP 63037041 A * 2/1988
JP 4-88444 U 7/1992
JP 11133767 A * 5/1999
JP 2001-122465 A 5/2001
JP 2002-160844 A 6/2002

* cited by examiner

*Primary Examiner*—Stefanos Karmis
*Assistant Examiner*—Luis Gonzalez
(74) *Attorney, Agent, or Firm*—Birch, Stewart, Kolasch & Birch, LLP

(57) ABSTRACT

A feed roller assembly includes a shaft, a plurality of rollers, and a plurality of covers. The rollers are fixed to the shaft at intervals along it. The covers are positioned at both ends of the rollers and surround the shaft, without being fixed to it. Paper dust falls from the outer cylindrical surfaces of the rollers and accumulates on the covers, without coming into direct contact with the cylindrical surface of the shaft. Because the covers are not fixed to the cylindrical surface of the shaft, they rotate at a lower speed than the shaft.

8 Claims, 4 Drawing Sheets

FEED ROLLER ASSEMBLY AND IMAGE FORMING APPARATUS

CROSS REFERENCE

This Nonprovisional application claims priority under 35 U.S.C. §119(a) on Patent Application No. 2006-212552 filed in Japan on Aug. 3, 2006, the entire contents of which are hereby incorporated by reference.

BACKGROUND OF THE INVENTION

The present invention relates to a feed roller assembly for feeding sheets of paper in an image forming apparatus for forming images on the sheets. The invention also relates to an image forming apparatus fitted with a feed roller assembly.

It is strongly demanded that an image forming apparatus for forming images on sheets of paper being fed in the apparatus should form images at a higher speed. In order to form images on sheets of paper at a higher speed, it is necessary to feed the sheets at a higher speed. In an image forming apparatus, a feed roller set feeds sheets of paper, as disclosed in JP-2002-160844A, for example.

The feed roller set consists of a driving roller assembly and a driven roller assembly. Each of the roller assemblies includes a shaft and rollers, which are fixed to the cylindrical surface of the shaft at intervals along the shaft. The driven roller assembly is biased toward the driving roller assembly so that the cylindrical surface of each of the rollers of the driving roller assembly can be in compressive contact with the cylindrical surface of one of the rollers of the driven roller assembly. A motor rotates the driving roller assembly with the driven roller assembly so as to feed the sheets through the roller nips between the assemblies. The rollers rotate at high speed to feed the sheets at high speed in the apparatus.

While the rollers are rotating at high speed, their cylindrical surfaces rub against the sheets, so that paper dust is produced from the sheets. The paper dust includes short cellulose fibers and part of the bulking filler and bleaching agent which were added when the sheets were produced. The compressive force between each of the rollers of the driving roller assembly and the associated roller of the driven roller assembly is greatest in the middle of the rollers, so that the paper dust produced from the sheets and sticking to the cylindrical surfaces of the rollers moves from the middle of each of the rollers to both ends of the roller and falls on the cylindrical surfaces of the shafts between the rollers. The fallen paper dust accumulates around the shafts between the rollers.

The accumulating paper dust is heated by its friction against the cylindrical surfaces of the shafts rotating at high speed, and/or against ends of the rollers rotating at high speed. As a result, the apparatus may break down or fire.

One object of the present invention is to provide a feed roller assembly which prevents the paper dust accumulating around its shaft between its rollers from coming into contact with the shaft and the ends of the rollers rotating at high speed with the shaft.

Another object of the present invention is to provide an image forming apparatus prevented reliably from breaking down or firing due to the frictional heat generated by its feed roller assembly.

SUMMARY OF THE INVENTION

A feed roller assembly according to the present invention includes a shaft, rollers, and covers. The rollers are fixed to the shaft at intervals along it. The covers are positioned at both ends of the rollers and surround the shaft, without being fixed to it. Paper dust falls from the cylindrical surfaces of the rollers and accumulates on the covers, without coming into direct contact with the cylindrical surface of the shaft. Because the covers are not fixed to the shaft, they rotate at a lower speed than it.

DETAILED DESCRIPTION OF THE INVENTION

Preferred embodiments of the present invention will be described below in detail with reference to the accompanying drawings.

Figure 1:
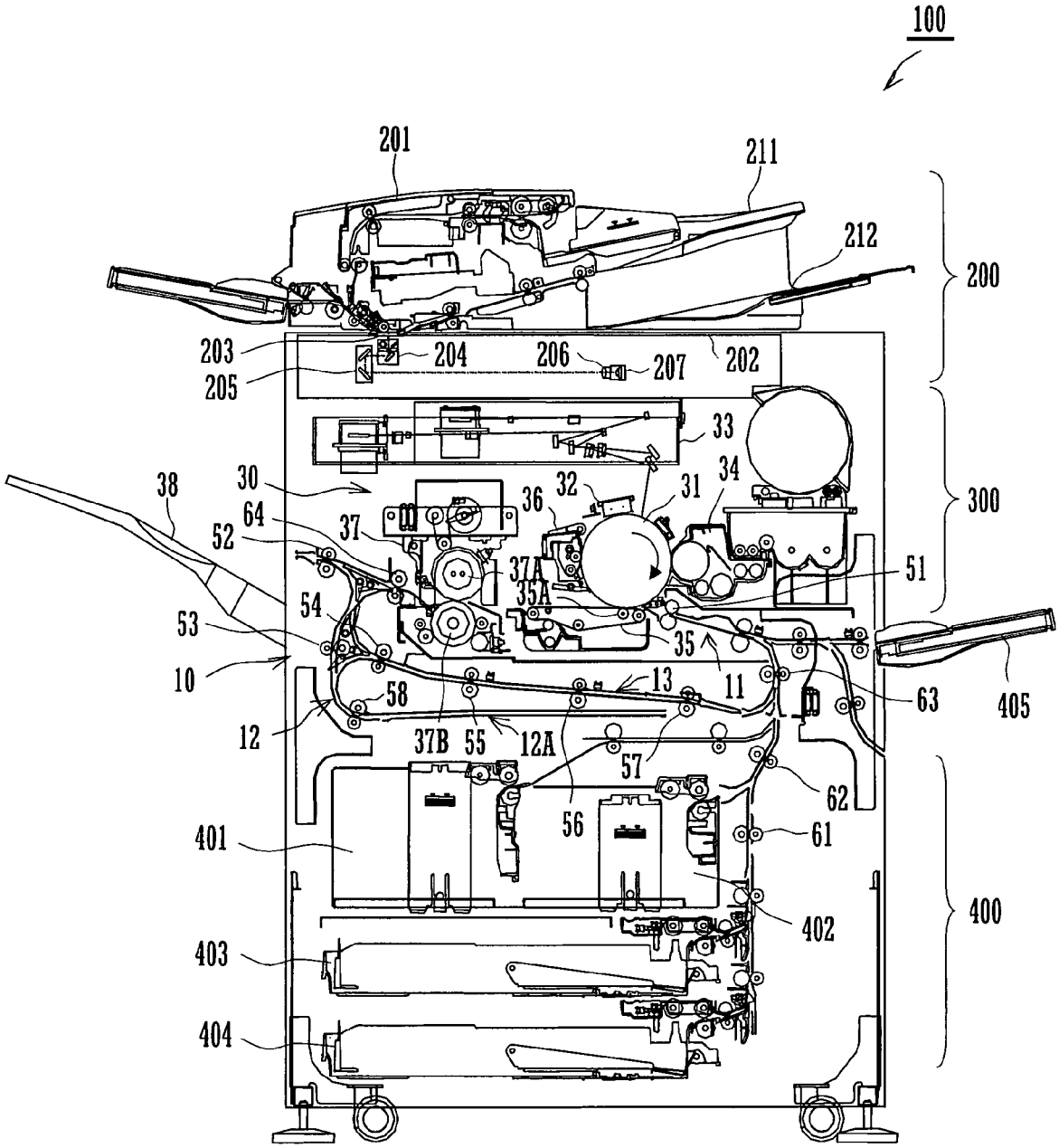
FIG. 1 is a sectional front view of an image forming apparatus according to a first embodiment of the present invention.

FIG. 1 shows an image forming apparatus 100 embodying the present invention. The apparatus 100 consists substantially of an image reading unit 200, an image recording unit 300, and a paper feeding unit 400. The apparatus 100 forms an image by means of electrophotography on a sheet of paper fed by feed rollers.

The image reading unit 200 includes an automatic document feeder (ADF) 201, a first document platform 202, a second document platform 203, a first mirror base 204, a second mirror base 205, a lens 206, and a solid-state image pickup device 207.

The ADF 201 conveys documents one after one from a document tray 211 via the second document platform 203 to an outlet tray 212. The rear edge of the ADF 201 is supported pivotably in such a manner that the ADF can cover the top of the first document platform 202. By raising the front edge of the ADF 201 so as to expose the first document platform 202, it is possible to place a document manually on this platform.

The document platforms 202 and 203 are a hard glass plate.

The mirror bases 204 and 205 are supported horizontally movably under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed by the ADF 201 is read with the first mirror base 204 stopping under the second document platform 203. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 is read with the mirror bases 204 and 205 moving horizontally under this platform. The light source on the first mirror base 204 moving under the first document platform 202 radiates light to the front side of the document on this platform. The light reflected by this side of the document is then reflected by the first mirror on the first mirror base 204 toward the second mirror base 205.

Whether the ADF 201 is used or not, the light reflected by the front side of the document is incident on the solid-state image pickup device 207 via the lens 206 by means of the second and third mirrors on the second mirror base 205, with the optical path length kept constant.

The solid-state image pickup device 207 may be a charge coupled device (CCD) and outputs an electric signal based on the quantity of light reflected by the front side of the document. The electric signal is input as image data into the image forming unit 300.

The image recording unit 300 includes an image former 30 consisting of a photosensitive drum 31, a charging device 32, an exposure device 33, a developing device 34, a transfer belt 35, a cleaner 36, and a fixing device 37.

The photosensitive drum 31 has a photosensitive layer formed on its cylindrical surface and rotates clockwise in FIG. 1. The charging device 32 charges the drum surface uniformly to a preset electric potential. The charging device 32 may be a non-contact type charging device with a charger or needle electrodes, or be a contact type charging device with a roller or a brush.

The exposure device 33 irradiates the cylindrical surface of the photosensitive drum 31 with light based on the image data. Photoconduction in the photosensitive layer of the drum 31 forms an electrostatic latent image on the irradiated surface of the drum 31. The exposure device 33 scans the drum surface axially of the drum 31 by means of a polygon mirror with a laser beam modulated with the image data. Alternatively, the exposure device 33 might be replaced by an exposure device having an array of ELs, LEDs, or other light emitting devices.

The developing device 34 supplies the cylindrical surface of the photosensitive drum 31 with toner so as to make the electrostatic latent image visible.

The transfer belt 35 forms a loop around rollers under the photosensitive drum 31 and has an electric resistance between about $1\times10^{9}$ and $1\times10^{13}$ Ω·cm. A transfer roller 35A is supported inside the transfer belt 35 and biased to bring it into compressive contact with the cylindrical surface of the photosensitive drum 31. A transfer voltage is applied to the transfer roller 35A. The toner image on the drum 31 is transferred to a sheet of paper passing between the drum and the transfer belt 35.

The cleaner 36 removes the toner remaining on the portion of the drum surface from which the toner image has been transferred.

The fixing device 37 includes a heating roller 37A and a pressing roller 37B. The heating roller 37A has a heater fitted in it for heating it to a temperature at which the toner on this roller can melt. The pressing roller 37B is biased under a preset pressure against the heating roller 37A. While the sheet with the toner image on it is passing between the rollers 37A and 37B, the fixing device 37 heats and presses the sheet so as to fix the image fast on the sheet. After passing through the fixing device 37, the sheet is conveyed to an outlet tray 38, which is fitted on the right (left in FIG. 1) side of the image forming apparatus 100.

The image recording unit 300 has a paper feeding passage 10 formed in it, which includes a first feed passage 11, a second feed passage 12, and a third feed passage 13.

The paper feeding unit 400 includes feed cassettes 401-404 and a manual feed tray 405. Each of the feed cassettes 401-404 holds sheets of paper of a size. The manual feed tray 405 supports a sheet of paper of size or quality for less frequent use.

The paper feeding unit 400 feeds sheets of paper one after one from one of the feed cassettes 401-404 or the manual feed tray 405. A sheet of paper fed from the feeding unit 400 is then fed to the image former 30 through the first feed passage 11.

The first feed passage 11 leads from the paper feeding unit 400 via the image former 30 to the outlet tray 38. A registration roller set 51, a delivery roller set 52, and feed roller sets 61-64 are fitted on the first feed passage 11.

The portion of the first feed passage 11 which leads through the image former 30 is substantially horizontal. The transfer belt 35 is fitted in this passage portion so as to stably transfer a toner image from the photosensitive drum 31 to a sheet of paper and stably feed the sheet to which the image has been attracted electrostatically before fixed.

The second feed passage 12 leads from a point on the first feed passage 11 which is positioned between the image former 30 and the outlet tray 38 to a first switchback 12A. The first switchback 12A is substantially parallel with the portion of the first feed passage 11 which leads through the image former 30. A sheet of paper reciprocates along the first switchback 12A. A reversing roller set 58 is fitted on the second feed passage 12.

The third feed passage 13 leads from the point on the first feed passage 11 which is positioned between the image former 30 and the outlet tray 38 to a point on the first passage 11 which is positioned between the paper feeding unit 400 and the image former 30. Feed roller sets 54-57 are fitted on the third feed passage 13.

Figure 2:
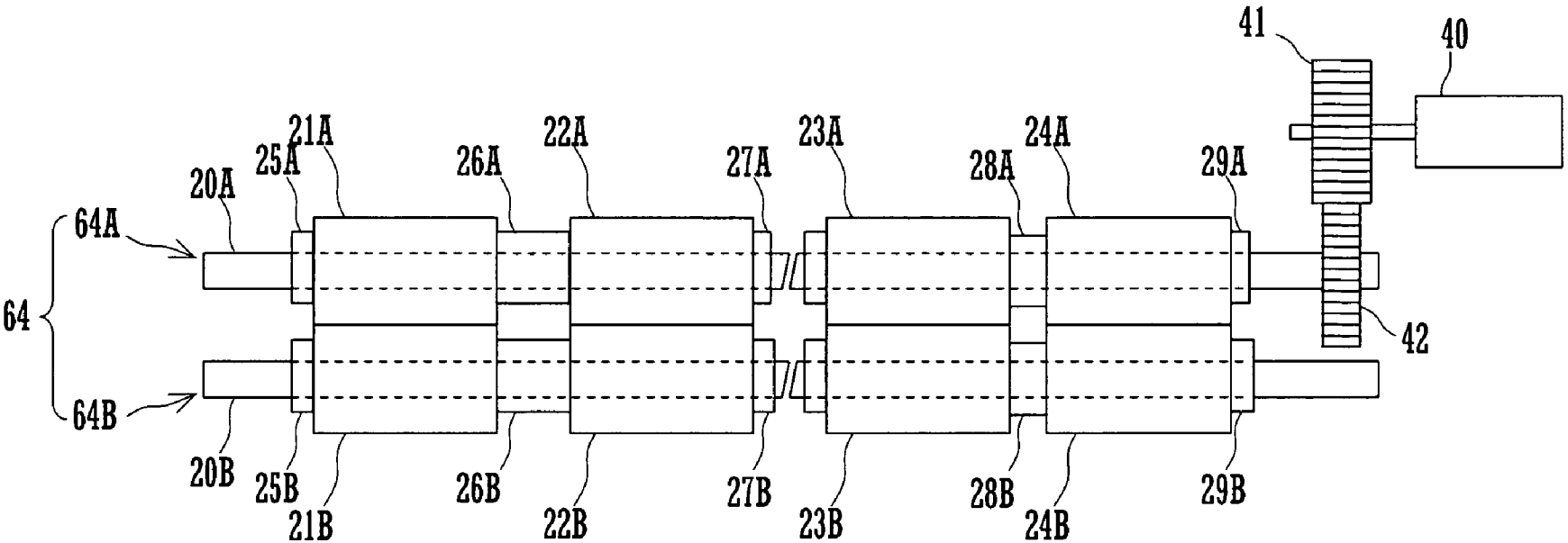
FIG. 2 is a side view of a feed roller set of the image forming apparatus shown in FIG. 1.

FIG. 2 shows the feed roller set 64, which consists of a driving roller assembly 64A and a driven roller assembly 64B. The roller assemblies 64A and 64B correspond to the feed roller assembly of the present invention.

The driving roller assembly 64A includes a shaft 20A, rollers 21A-24A, and collars 25A-29A. The rollers 21A-24A are cylindrical, larger in diameter than the shaft 20A, and fixed to it coaxially with it at intervals. The collars 25A-29A surround the shaft 20A, without being fixed to it. The collar 25A is positioned at the front end of the roller 21A. The collar 26A is interposed between the rollers 21A and 22A. The collar 27A is interposed between the rollers 22A and 23A. The collar 28A is interposed between the rollers 23A and 24A. The collar 29A is positioned at the rear end of the roller 24A.

A gear 42 is fixed to the rear end of the shaft 20A. A gear 41 is fixed to the shaft of a motor 40. The gears 41 and 42 are in mesh with each other. The torque of the motor 40 is transmitted through the gears 41 and 42 to the driving roller assembly 64A.

The driven roller assembly 64B includes a shaft 20B, rollers 21B-24B, and collars 25B-29B. The rollers 21B-24B are cylindrical, larger in diameter than the shaft 20B, and fixed to it coaxially with it at intervals. The collars 25B-29B surround the shaft 20B, without being fixed to it. The collar 25B is positioned at the front end of the roller 21B. The collar 26B is interposed between the rollers 21B and 22B. The collar 27B is interposed between the rollers 22B and 23B. The collar 28B is interposed between the rollers 23B and 24B. The collar 29B is positioned at the rear end of the roller 24B.

The driven roller assembly 64B is biased toward the driving roller assembly 64A so that the cylindrical surfaces of the rollers 21B-24B can be in compressive contact with the cylindrical surfaces of the rollers 21A-24A respectively under a preset pressure. The torque of the driving roller assembly 64A rotated by the motor 40 is transmitted to the driven roller assembly 64B by the compressive contact between the rollers 21A-24A and the rollers 21B-24B respectively, so that the assemblies 64A and 64B rotate in opposite directions at the same speed. The feed roller set 64 feeds a sheet of paper through the nips between the rollers 21A-24A and the rollers 21B-24B respectively.

The collars 25A-29A and 25B-29B, which correspond to the covers of the present invention, are not fixed to the shafts 20A and 20B, and are in contact under little pressure with the adjacent ends of the rollers 21A-24A and 21B-24B. Accordingly, the collars 25A-29A and 25B-29B rotate at lower speeds than the shafts 20A and 20B.

All or some of the registration roller set 51, delivery roller set 52, feed roller sets 53-57 and 61-63 and reversible roller set 58 of the image forming apparatus 100 are similar in structure to the feed roller set 64.

Figure 3:
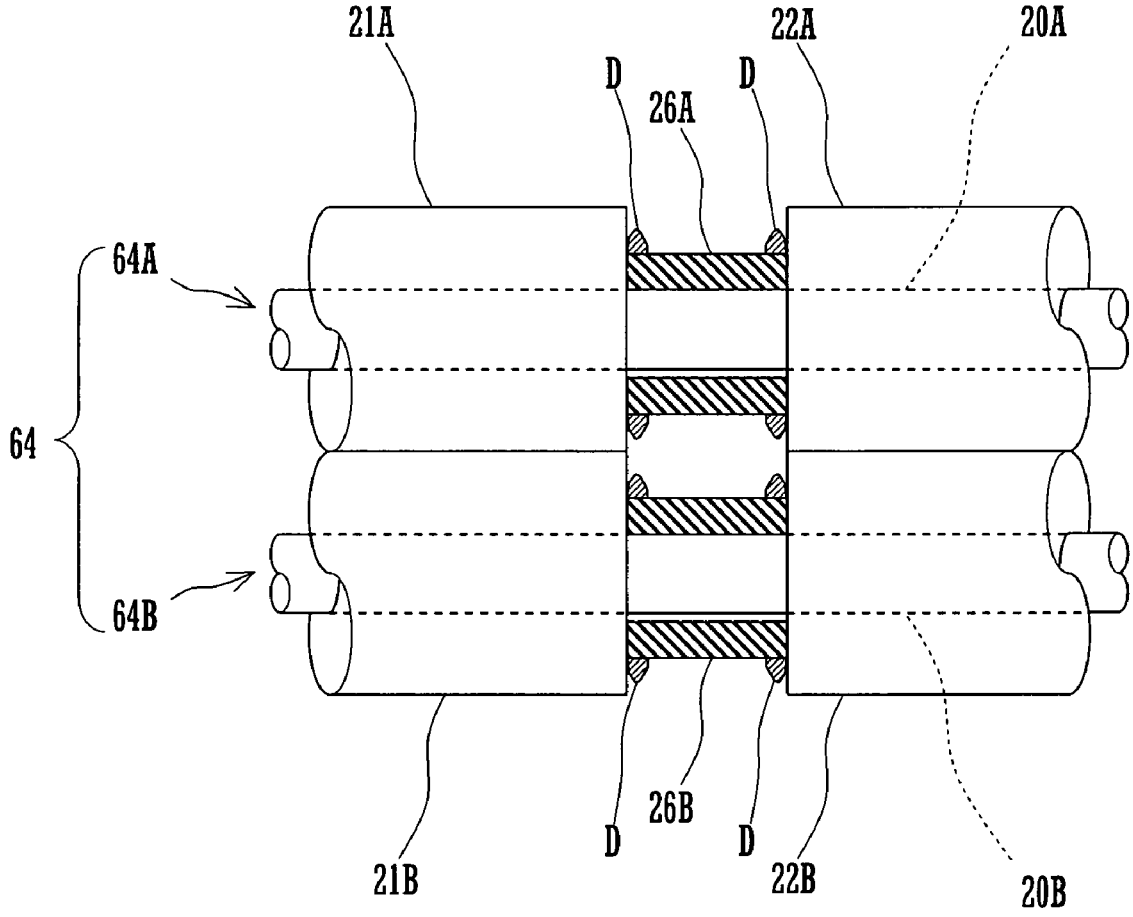
FIG. 3 is a side view partially in axial section of part of the feed roller set shown in FIG. 2.

With reference to FIG. 3, the collar 26A is cylindrical and equal in length to the space between the rollers 21A and 22A. The collar 26A is smaller in outer diameter than the rollers 21A and 22A. The inner diameter of the collar 26A is larger than the diameter of the shaft 20A, so that the inner cylindrical surface of the collar 26A is in contact at a line with the cylindrical surface of the shaft 20A. The ends of the collar 26A are in contact under little pressure with the adjacent ends of the rollers 21A and 22A. When the shaft 20A rotates with the rollers 21A and 22A at a high speed, the collar 26A rotates at a lower speed than the shaft and the rollers. The other collars 26B etc. of the feed roller set 64 are similar in structure to the collar 26A.

With reference to FIG. 3, while a sheet of paper is passing through the feed roller set 64, paper dust D produced from the sheet moves from the middle of the cylindrical surface of each of the rollers 21A, 21B, 22A, and 22B to both ends of the surface and falls between the rollers 21A and 22A, and between the rollers 21B and 22B.

The fallen dust D accumulates around the collars 26A and 26B. Even if the accumulating dust D sticks to the adjacent ends of the rollers 21A, 21B, 22A, and 22B, it does not come into contact with the cylindrical surfaces of the shafts 20A and 20B rotating at high speed. Even if the accumulating dust D sticks to the outer cylindrical surfaces of the collars 26A and 26B, it rotates with the collars at low speed, so that there is no great speed difference between the dust D and the adjacent ends of the rollers 21A, 21B, 22A, and 22B. This prevents the accumulating dust D from being hot due to frictional heat.

The feed roller set 64 is downstream from the fixing device 37 on the first feed passage 11. A sheet of paper heated to a high temperature at the fixing device 37 passes through the feed roller set 64, where hot paper dust D accumulates around the collars 26A and 26B. The accumulating dust D is kept from being hotter by creating friction against the cylindrical surfaces of the shafts 20A and 20B and the adjacent ends of the rollers 21A, 21B, 22A, and 22B. This prevents the apparatus from breaking down and firing.

Figure 4:
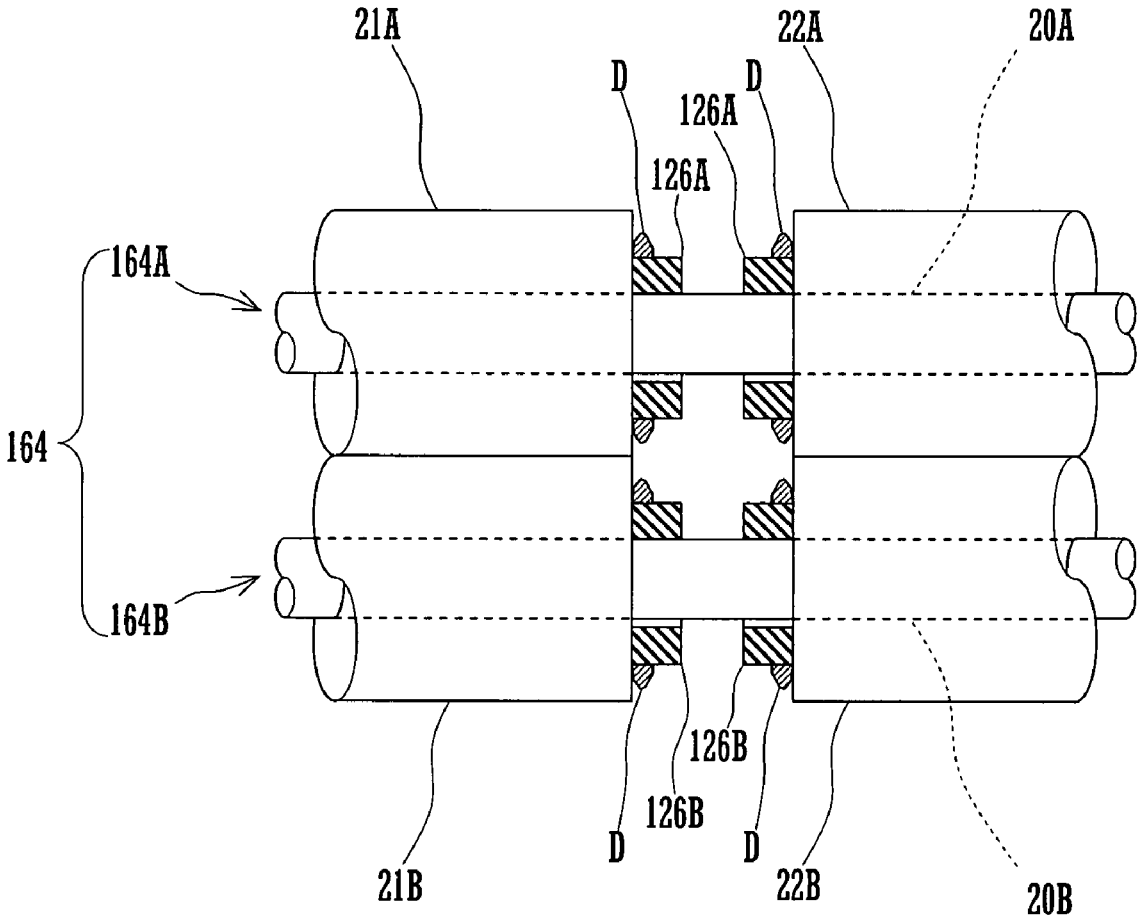
FIG. 4 is a side view partially in axial section of part of a feed roller set according to a second embodiment of the present invention.

FIG. 4 shows a feed roller set 164 according to a second embodiment of the present invention. The feed roller set 164 consists of a driving roller assembly 164A and a driven roller assembly 164B, which correspond to the feed roller assembly of the present invention. The feed roller set 164 is identical in structure with the feed roller set 64, except that the set 164 includes a pair of collars 126A and a pair of collars 126B, which correspond to the covers of the present invention, in place of the collars 26A and 26B respectively.

The collars 126A are cylindrical, shorter than the space between the rollers 21A and 22A, and smaller in outer diameter than them. The inner diameter of the collars 126A is larger than the diameter of the shaft 20A. The collars 126A surround the shaft 20A, and each of them is positioned at the adjacent end of one of the rollers 21A and 22A.

Each collar 126A is restrained from shifting axially along the shaft 20A, for example, by a ring (not shown) engaging with a peripheral groove (not shown) in the shaft. The inner cylindrical surface of each collar 126A is in contact at a line with the cylindrical surface of the shaft 20A. One side of each collar 126A is in contact under little pressure with the adjacent end of the associated roller 21A or 22A. When the shaft 20A rotates with the rollers 21A and 22A at a high speed, the collars 126A rotate at lower speeds than the shaft and the rollers. The other collars 126B etc. of the feed roller set 164 are similar in structure to the collar 126A.

The axial dimension of the collars 126A and 126B is larger than the ranges within which paper dust D falls. This enables the feed roller set 164 to bring about the same effect as the feed roller set 64 brings about.

As far as the collars 26A, 26B, 126A, and 126B surround the shafts 20A and 20B, it is not essential that they be cylindrical.

It should be considered that the foregoing description of the embodiments is illustrative in all respects and not restrictive. The scope of the present invention is defined by the appended claims, not by the embodiments, and intended to include meanings equivalent to those of the elements of the claims and all modifications in the claims.

What is claimed is:

1. A feed roller assembly comprising:

a shaft;

a plurality of rollers supported by the shaft at intervals along the shaft, the plurality of rollers being fixed to the shaft; and a plurality of covers surrounding the shaft outside both ends of each roller, without being fixed to the shaft wherein the covers are cylindrical and smaller in outer diameter than the rollers, wherein the inner diameter of the covers is larger than the diameter of the shaft, and wherein both ends of each of the covers are in contact with sufficient pressure with adjacent ends of the rollers in such a manner as to rotate at a lower speed than the rollers.

2. A feed roller assembly as claimed in claim 1, wherein the rollers rotate with the shaft.

3. A feed roller assembly as claimed in claim 1, wherein the cover positioned in each of the spaces between the rollers is equal in axial dimension to the space where the cover is positioned.

4. A feed roller assembly as claimed in claim 2, wherein the cover positioned in each of the spaces between the rollers is equal in axial dimension to the space where the cover is positioned.

5. An image forming apparatus comprising:

an image former for forming an image on a sheet of paper;

a paper feeding passage leading through the image former; and a feed roller assembly comprising:

a shaft;

a plurality of rollers supported by the shaft at intervals along the shaft, the plurality of rollers being fixed to the shaft; and a plurality of covers surrounding the shaft outside both ends of each roller, without being fixed to the shaft wherein the covers are cylindrical and smaller in outer diameter than the rollers, wherein the inner diameter of the covers is larger than the diameter of the shaft, and wherein both ends of each of the covers are in contact with sufficient pressure with adjacent ends of the rollers in such a manner as to rotate at a lower speed than the rollers;

wherein the feed roller assembly being fitted on the paper feeding passage and adapted to feed the sheet therethrough.

6. A feed roller assembly comprising:

a shaft;

a plurality of rollers supported by the shaft at intervals along the shaft, the plurality of rollers being fixed to the shaft; and a plurality of covers completely encircling the shaft outside both ends of each roller, without being fixed to the shaft, wherein both ends of each of the covers are in contact with sufficient pressure with adjacent ends of the rollers in such a manner as to rotate at a lower speed than the rollers.

7. A feed roller assembly comprising:

a shaft;

a plurality of rollers supported by the shaft at intervals along the shaft, the plurality of rollers being fixed to the shaft; and a plurality of cylindrical covers surrounding the shaft outside both ends of each roller, without being fixed to the shaft, wherein both ends of each of the covers are in contact with sufficient pressure with adjacent ends of the rollers in such a manner as to rotate at a lower speed than the rollers.

8. A feed roller assembly comprising:

a shaft;

a plurality of rollers supported by the shaft at intervals along the shaft, the plurality of rollers being fixed to the shaft; and a plurality of covers surrounding the shaft outside both ends of each roller, without being fixed to the shaft, wherein each of the covers are comprised of a single unit, and wherein both ends of each of the covers are in contact with sufficient pressure with adjacent ends of the rollers in such a manner as to rotate at a lower speed than the rollers.

* * * * *